US005117986A

United States Patent [19]

Lin

[11] Patent Number: 5,117,986

[45] Date of Patent: Jun. 2, 1992

[54] SHELF WITH HEIGHT AND ANGLE ADJUSTMENT

[76] Inventor: Hsin-Hsiung Lin, #512, Sec. 3, Chung-Hua E. Rd.,, Tainan City, Taiwan

[21] Appl. No.: 687,951

[22] Filed: Apr. 19, 1991

[51] Int. Cl.[5] ..... A47F 5/08

[52] U.S. Cl. ..... 211/90; 211/103; 108/2; 108/6

[58] Field of Search ..... 108/6, 2, 5, 10, 146; 248/242, 243, 244; 211/90, 103

[56] References Cited

U.S. PATENT DOCUMENTS

| | | | |
|---|---|---|---|
| 891,228 | 6/1908 | Bowen | 211/103 |
| 945,280 | 1/1910 | Lindberg | 108/6 X |
| 1,261,513 | 4/1918 | Green | 211/90 X |
| 3,151,576 | 10/1964 | Patterson | 108/2 |
| 3,161,159 | 12/1964 | Kritske | 108/2 |
| 3,167,037 | 8/1961 | Mapson | 108/6 |
| 3,403,789 | 10/1968 | Morte et al. | 108/2 |
| 3,550,891 | 12/1970 | Scott | 108/6 X |
| 3,561,713 | 2/1971 | Berkowitz | 108/6 X |
| 3,908,561 | 9/1975 | Cowley | 108/2 X |
| 4,383,486 | 5/1983 | Reineman et al. | 108/10 X |

*Primary Examiner*—Carl D. Friedman
*Assistant Examiner*—Korie H. Chan
*Attorney, Agent, or Firm*—Fleit, Jacobson, Cohn, Price, Holman & Stern

[57] ABSTRACT

A shelf has a device to adjust its height on a pair of mounting rails and a device to adjust its angle with respect to the mounting rails.

2 Claims, 5 Drawing Sheets

SHELF WITH HEIGHT AND ANGLE ADJUSTMENT

BACKGROUND OF THE INVENTION

1. Field of Invention

The present invention relate to a shelf, more particularly to a shelf mounted on a pair of rails fixed on a wall, which shelf can be raised or lowered to a desired height and such that the angle between the shaft and said fixed rails can be adjusted.

2. Description of the Related Art

FIG. 1 shows a conventional shelf. As illustrated in Figure, the shelf includes a pair of rails (10) fixedly mounted on a wall and a plate (20) disposed on the rails (10). Such a shelf can not be lowered or raised as desired.

FIG. 2 shows another type of conventional shelf. Accordingly, it includes a pair of rails (10) having a plurality of holes, fixedly mounted on a wall. A plate (20) is provided on a pair of studs inserted in these holes. The plate (20) of such a shelf can be raised or lowered when desired, but the angle of the plate with respect to the rails (10) can not be changed.

SUMMARY OF THE INVENTION

Therefore, the main object of the present invention is to provide a shelf with provision by which the height and angle of the shelf with respect to the mounting wall can be adjusted.

Accordingly, a shelf of the present invention includes a pair of rails, spaced apart from one another in a parallel relationship, and vertically mounted on a wall, a rectangular frame having a first elongated member disposed between said pair of rails, and a second elongated member extending substantially perpendicular to said first elongated member, an engaging member which is slidable along said rail, and disposed between one end of said first elongated member and said rail, means to retain said first elongated member at a desired height along said rails by said engaging member and means to retain said second elongated member at a desired angle with respect to said rails by said engaging member.

BRIEF DESCRIPTION OF THE DRAWINGS

Other features and advantages of the present invention will become more apparent in the following detailed description, including drawings, all of which show a non-limiting form of the invention, and of which.

DETAILED DESCRIPTION OF THE PREFERRED EMBODIMENT

Figure 2:
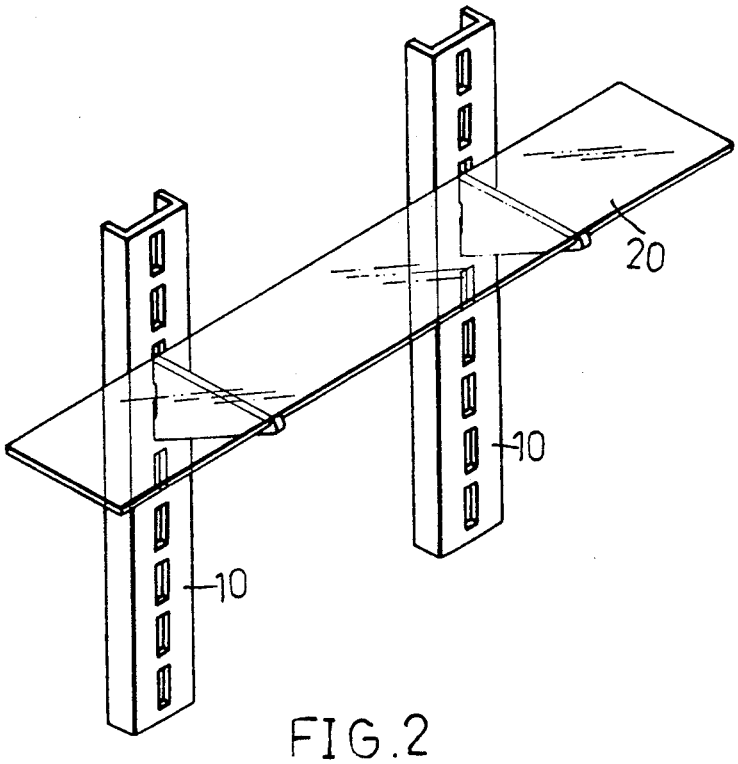
FIG.2 PRIOR ART
FIGS. 1 and 2 show two kinds of conventional shelves.
Figure 1:
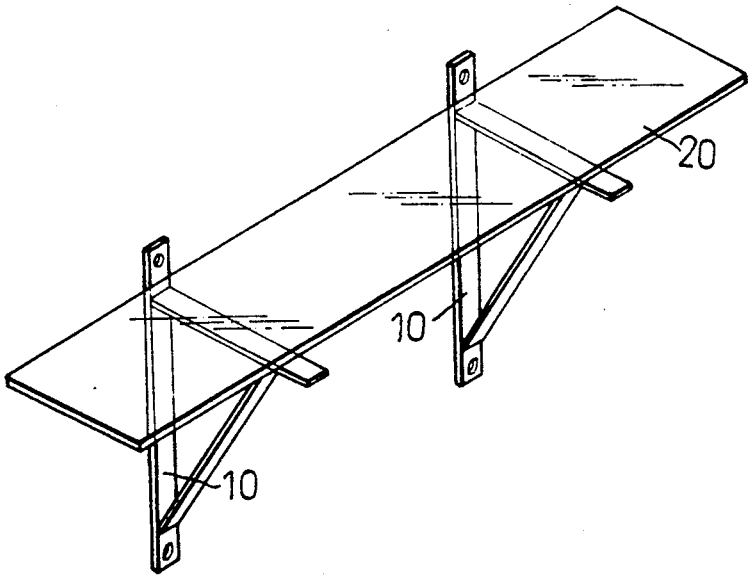
FIG.1 PRIOR ART
Figure 3:
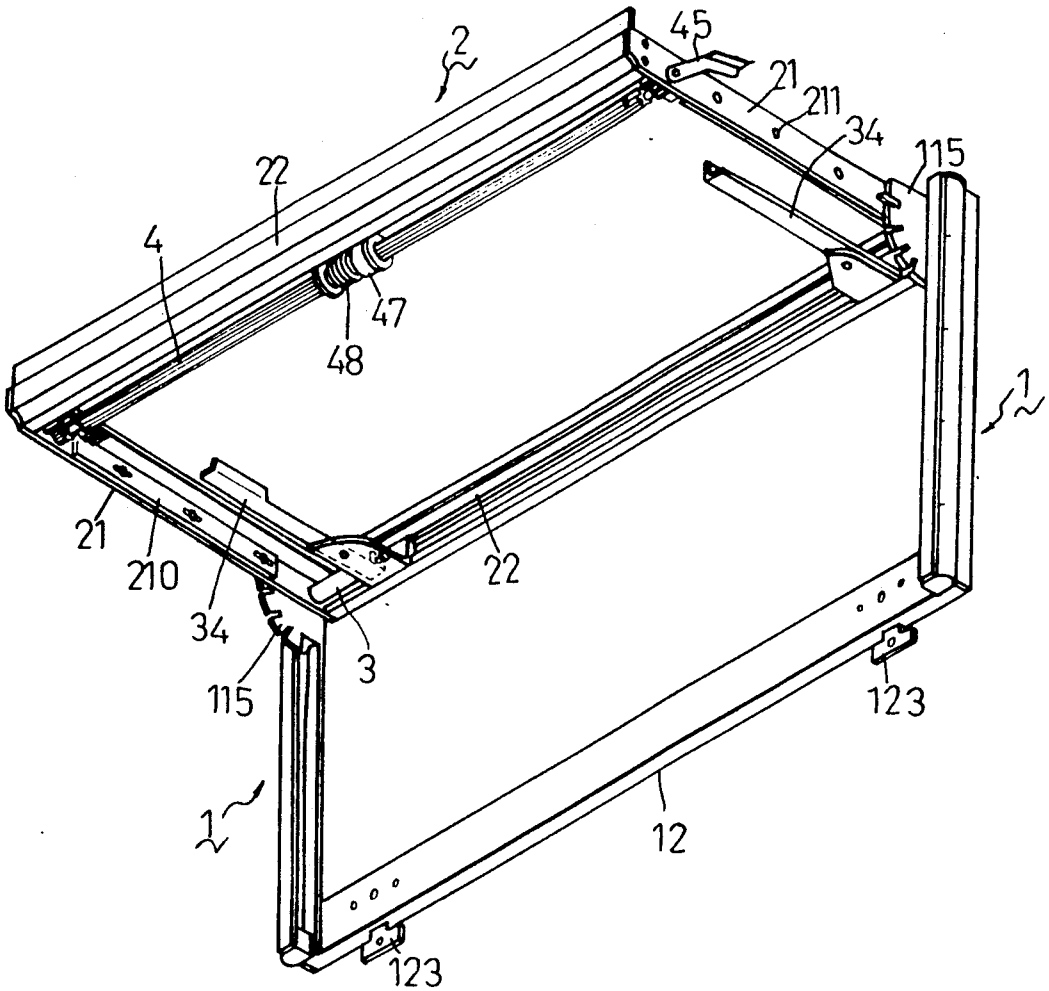
FIG. 3 is a perspective, schematic view of a shelf of the present invention.
Figure 4:
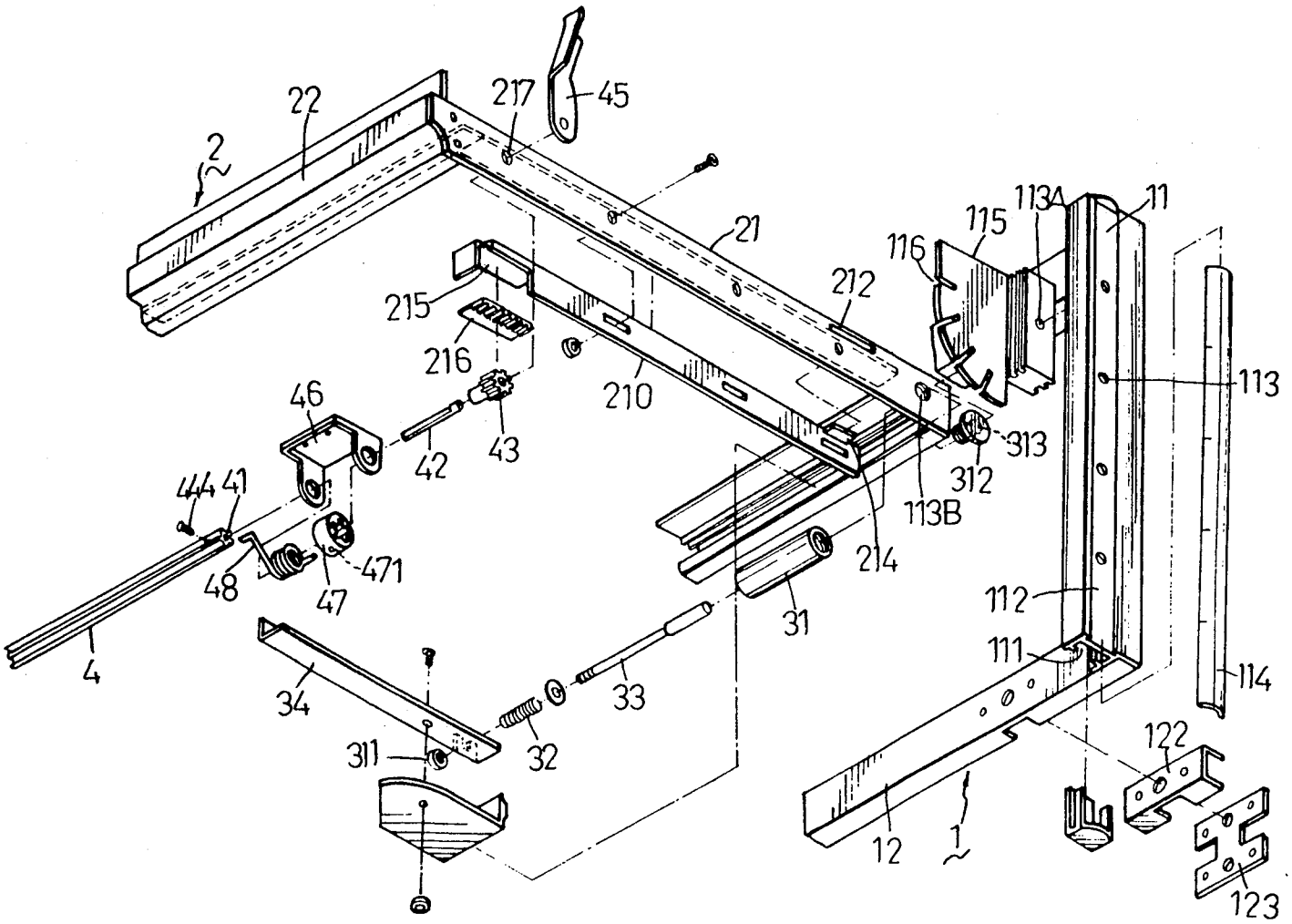
FIG. 4 is an exploded view of a shelf, according to the present invention.
Figure 5:
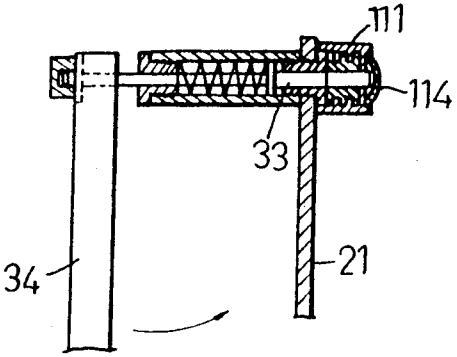
FIG. 5 illustrates installation of a shelf of the present invention and adjustment of its height.

Referring to FIGS. 3 and 4, a shelf of the present invention includes a pair of rails (1), spaced apart from one another in a parallel relationship, and vertically mounted on a wall. Each of the rails (1) includes an inner recess (111) and an outer recess (112) formed along said rail. The outer recess (112) has a plurality of positioning holes (113) formed therealong. The outer recess (112) is covered by an elongated plate (114) to enhance its appearance.

A rectangular frame (2) includes a first elongated plate (22) disposed between the two rails, and a second elongated plate (21) extending perpendicularly from the first elongated plate (22). The second elongated plate (21) has a mounting hole (**113*b***) adjacent to one end thereof.

Each of an engaging members (115) have a through-hole (113A) aligned with the mounting hole (113B) of the second elongated plate (21) and a curved edge. The outer edge of the curved edge has a plurality of notches (116) along, and the engaging member (115) is disposed between one end of the elongated plate (22) and each of the rails (1). The engaging members (115) are slidable in the inner recess (111) of the rail (1).

A hollow tube (31) has a first end flush with the periphery of the mounting hole (113B) of the second elongated plate (21). A cap (312) has a threaded stem and a through-hole (313) along the axis of the stem. The stem passes through the mounting hole (113B) and holds the hollow tube (31) in place. A slit (212) is formed on the second elongated plate (21) adjacent to said mounting hole (113B). A rod (33) is received in the hollow tube (31) around which, a coil spring (32) is sleeved over the rod (33). The coil spring (32) urges a first end of the rod (33) to extend out of the first end of the hollow tube (31), passing through the through-hole (113A) of the engaging member (115), and through the cap (312) into one of the holes (113) of the rail. Thus, the first elongated plate (22) is engaged in said rail. A second end of the rod (33) extends out of the second end of the hollow tube (31) and is connected to a pull member (34). Under these conditions, the hollow tube (31) is adjacent to and parallel to the first elongated plate (22). The second end of the elongated rod (33) is connected to the pull member (34) and secured thereat by means of a screw (311). The first end of the elongated rod (33) can be retracted from the hole (113) of the rail (1) into the hollow tube (31), by pulling the pull member (34). Thus, the first elongated plate (22) can be raised or lowered to a desired height along the rails (1).

The second elongated plate (21) has a slit (212) adjacent to the mounting hole (113B) of the same. An elongated plate (210) has a tab (214) laterally extending from one end thereof. The other end of the elongated plate (210) has a recess portion (215) into which recess portion, a serrated plate (216) is fixedly mounted. The elongated plate (210) is mounted on the second elongated plate (21), as illustrated in FIG. 4, with the tab (214) of the elongated plate extending out of the slit (212) of the second elongated plate (21).

A toothed rod (4) has an axial through-hole (41), into which a first end of a linking rod (42), is inserted and secured by means of a screw (444). A threaded wheel (43) is coaxially mounted in a position adjacent to a second end of the linking rod (42). The threaded wheel (43) of the linking rod (42) is engaged with the serrated end of the elongated plate (210). The second end of the linking rod (42) passes through the hole (217) of the second elongated plate (21) and is connected to a control arm (45).

A bracket (46) has a ring (47) through which the toothed rod (4) passes. The bracket (46) is fixed to the other first member (22), in-between a pair of the second elongated plates (21). The ring (47) has an internally toothed hole to engage with the toothed rod (4). The spring (48) has one end abutting the inner portion of the bracket (46) while the other end is fixed in a hole (471) in the ring (47). Thus the toothed rod 4 is spring loaded, and will return to a predetermined rest condition unless force is applied to rotate it axially.

Figure 6:
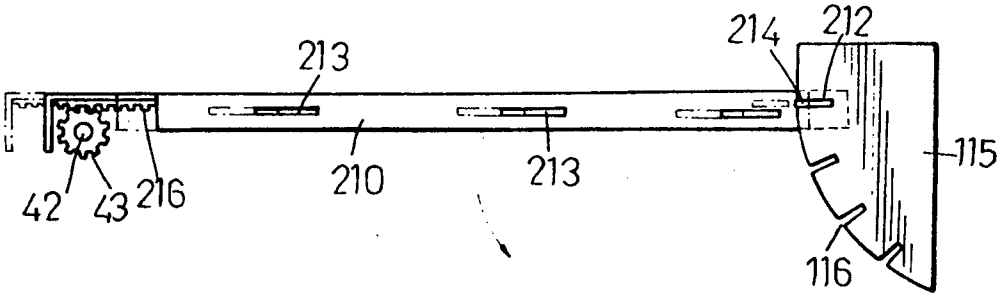
FIG. 6 is an illustration of how the angle of the present invention can be adjusted.

As shown in FIG. 6, the assembly is arranged such that when the toothed rod (4) is in the rest position, the toothed wheel (43) holds the plate (210) in a position where the tab (214) at the end of the plate (210) passes through the slit (212) in the second elongated plate (21) to engage one of the notches (116) of the engaging members (115). The control arm (45), being fixed to the toothed wheel (43), can be rotated against the force of the spring (46) which will cause the wheel (43) to spin. The teeth of the wheel (43), being engaged in the serrated plate (216), will draw the plate (210) toward the toothed rod (4), pulling the tab (214) free of the notch (116). Then the angle of the shelf can be changed. Releasing control arm (45) will allow the assembly to return to the rest condition, fixing the shelf in the selected angular relationship with the rails.

Figure 7:
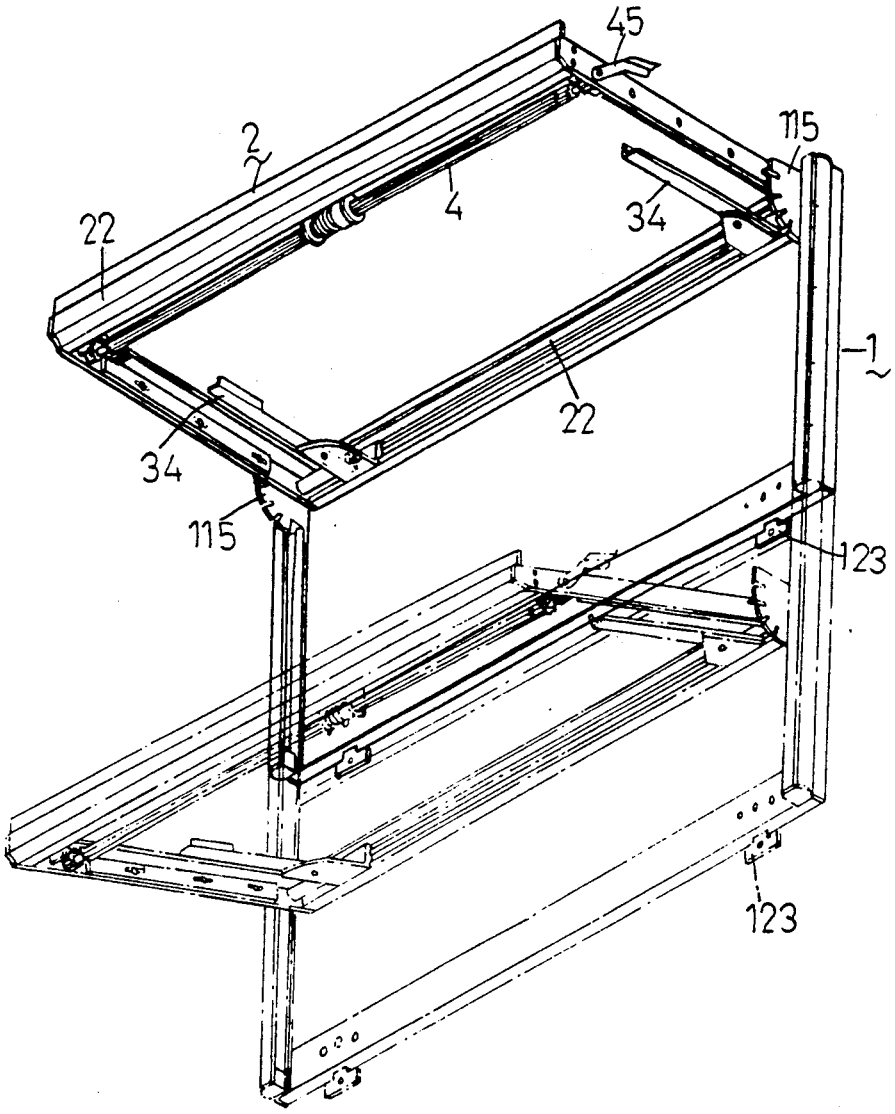
FIG. 7 shows a shelf of the present invention in use.

As illustrated in FIG. 7, a connecting bar (12) is provided between the pair of rails (1). Some fastening plates (122,123) are also provided on the connecting bar (12) through which screws can be inserted to secure the entire assembly to a mounting wall. The method of adjusting the shelf was described above.

With the invention thus explained, it is obvious to those skilled in the art that various modifications and variations can be made without departing from the scope and spirit of the present invention. It is therefore intended that this invention be limited only as indicated in the appended claims.

I claim:

1. A shelf comprising:

a pair of rails, spaced from one another in a parallel relationship, adapted to be mounted vertically on a wall;

a rectangular frame including a first elongated plate having two ends and disposed between said pair of rails, and a second elongated plate which has a mounting hole and an end connected perpendicularly to one of the ends of said first elongated plate;

an engaging member mounted between each end of said first elongated plate and each of said rails, said engaging member having a curved edge with a plurality of notches formed along said curved edge, said engaging member being slidably mounted on one of said rails along the length thereof;

means for retaining said engaging member at a predetermined height along said rails, said means including a rod having two ends and a hollow tube having a first end connected to the mounting hole of said second elongated plate adjacent to said rail, each of said rails having a plurality of positioning apertures formed along its length, said hollow tube receiving the rod therein;

resilient means provided in said hollow tube for urging one end of said rod to pass through said mounting hole of said second elongated plate, said engaging member and one of said positioning apertures of said rail in turn;

the other end of said rod extending out of the free end of said hollow tube being connected to a pull member, said pull member retracting said end of said rod from said rail and said engaging member into said hollow tube when said pull member is moved away from said free end of said hollow tube, so that said frame can be moved along said rails; and means for selectively engaging said second elongated plate in one of said notches of said curved edge of said engaging member so as to form an adjustable angle between said second elongated plate and one of said rails.

2. A shelf as claimed in claim 1, wherein said engaging means includes a slide plate having a tab projecting laterally adjacent to one end thereof, said second elongated plate having a slit adjacent to said mounting hole of said second elongated plate, said slide plate being mounted parallel to said second elongated plate with said tab of said slide plate extending out of said slit of said second elongated plate, means for pushing said tab of said slide plate to engage in one of said notches of said engaging member, and means for pulling said tab out of said notch of said engaging member.

* * * * *